US007862023B2

(12) United States Patent
Ichihashi et al.

(10) Patent No.: US 7,862,023 B2
(45) Date of Patent: Jan. 4, 2011

(54) SHEET PROCESSING DEVICE AND IMAGE FORMING APPARATUS

(75) Inventors: Ichiro Ichihashi, Aichi (JP); Masahiro Tamura, Kanagawa (JP); Nobuyoshi Suzuki, Tokyo (JP); Shuuya Nagasako, Kanagawa (JP); Kazuhiro Kobayashi, Kanagawa (JP); Hiroshi Maeda, Aichi (JP); Tomoichi Nomura, Aichi (JP); Makoto Hidaka, Tokyo (JP); Hitoshi Hattori, Tokyo (JP); Akira Kunieda, Tokyo (JP); Shohichi Satoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 649 days.

(21) Appl. No.: 11/843,729

(22) Filed: Aug. 23, 2007

(65) Prior Publication Data

US 2008/0048380 A1 Feb. 28, 2008

(30) Foreign Application Priority Data

Aug. 23, 2006 (JP) ..... 2006-226796

(51) Int. Cl.
*B65H 37/04* (2006.01)

(52) U.S. Cl. ..... 270/58.09; 270/58.07; 270/58.08; 270/58.12

(58) Field of Classification Search ..... 270/52.18, 270/58.07, 58.08, 58.09, 58.12
See application file for complete search history.

(56) References Cited

U.S. PATENT DOCUMENTS

| | | | | |
|---|---|---|---|---|
| 5,951,000 | A * | 9/1999 | Sato et al. | 270/58.11 |
| 6,145,825 | A * | 11/2000 | Kunihiro et al. | 270/58.09 |
| 6,220,592 | B1 * | 4/2001 | Watanabe et al. | 271/241 |
| 6,241,234 | B1 * | 6/2001 | Saitoh et al. | 270/58.12 |
| 2006/0261544 | A1 | 11/2006 | Tamura | |
| 2007/0029716 | A1 | 2/2007 | Yamada | |
| 2007/0051219 | A1 | 3/2007 | Tamura | |
| 2007/0052147 | A1 | 3/2007 | Tamura | |
| 2007/0138726 | A1 | 6/2007 | Tamura | |

FOREIGN PATENT DOCUMENTS

| | | |
|---|---|---|
| JP | 2574959 | 10/1996 |
| JP | 3748710 | 9/2002 |
| JP | 2004-182399 | 7/2004 |
| JP | 3617936 | 11/2004 |

* cited by examiner

*Primary Examiner*—Leslie A Nicholson, III
(74) *Attorney, Agent, or Firm*—Harness, Dickey & Pierce, P.L.C.

(57) ABSTRACT

A sheet processing device includes a stapling tray, a rear-end clamp, and a stapler that staples sheets while the rear-end clamp is clamping the sheets. In response to a start signal, the stapler moves to a position where the stapler does not interfere the rear-end clamp while being closest to a stapling position. When the last sheet of a sheet bundle to be stapled is conveyed into the stapling tray, timing at which the stapler moves to the stapling position is determined according to a preset condition.

10 Claims, 11 Drawing Sheets

SHEET PROCESSING DEVICE AND IMAGE FORMING APPARATUS

CROSS-REFERENCE TO RELATED APPLICATIONS

The present application claims priority to and incorporates by reference the entire contents of Japanese priority document, 2006-226796 filed in Japan on Aug. 23, 2006.

BACKGROUND OF THE INVENTION

1. Field of the Invention

The present invention relates to a sheet processing device, and an image forming apparatus.

2. Description of the Related Art

For sheet processing, such as aligning, sorting, stacking, stapling, folding, and punching sheet-type recording media including recording sheets, transfer sheets, overhead projector (OHP) sheets, sheets need to be aligned in a sheet-conveyance direction and in a direction perpendicular to the sheet-conveyance direction. To aid alignment of sheets in the sheet-conveyance direction, a rear-end fence is provided upstream in the sheet-conveyance direction for the trailing edge of the sheets to rest against, whereas a pair of aligning members (commonly known as jogger fences) are provided for aligning the sheets in the direction perpendicular to the sheet-conveyance direction by supporting the two lateral edges of the sheets.

For performing sheet processing such as stapling, it is important that the edges of sheets are aligned and pressed flat by a pressing member or the like. The use of such a pressing member would entail timing adjustment to avoid the pressing member getting in the way of a stapler. The timing adjustment ultimately affects productivity.

Several technologies are known for enhancing the level of preparedness of sheets for stapling. For example, Japanese Patent Application Laid-open No. H11-130338 discloses a conventional sheet processing device that includes a stapling tray for receiving and stacking sheets ejected from an image forming apparatus, a rear-end fence for supporting and aligning the edges of the sheets in a sheet-conveyance direction, and a stapler for stapling an edge of the sheet bundle aligned by the rear-end fence. The conventional sheet processing device further includes a regulating member that is movable in a thickness direction of the sheet bundle stacked in the stapling tray, and adjusts the distance from a sheet-loading surface of the stapling tray for guiding the sheets to the rear-end fence.

Japanese Patent Application Laid-open No. 2000-327208 discloses another conventional sheet processing device, integrally including a post-process tray, a conveyance path for guiding sheets towards the post-process tray, and a conveying member. The sheets in the post-process tray are ejected to a sheet discharge tray after stapling process, etc. The conveyance of the sheets is disallowed in the reverse direction beyond a predetermined spot in the conveyance path, and the sheet(s) that have crossed the predetermined spot is kept resting in a stand-by path provided downstream of the predetermined spot. The sheet(s) are conveyed on the stand-by path towards the post-process tray after stacking on them the next sheet that is conveyed via the conveying path. With this, productivity in image formation can be prevented from lowing without increasing the complexity and the size of the device or the cost involved.

Japanese Patent Application Laid-open No. 2004-182399 discloses a compact sheet processing device which can perform center stapling with high reliability and at low cost. The sheet processing device includes processing units for performing predetermined processes after image formation. The processing units include a stacker, aligning members, a first conveying member, a stapler, a moving member, a second conveying member, a folding member, and a retracting member. The stacker stacks thereon the sheets. The aligning members align the sheet bundle by pressing the downstream edge of the sheets flush against a first sheet-bundle regulating member in the sheet-conveyance direction as well as in a direction perpendicular to the sheet-conveyance direction. The first conveying member conveys the sheet bundle aligned by the aligning members to a second sheet-bundle regulating member. The stapler staples the sheet bundle, and the moving member moves the stapler in the direction perpendicular to the sheet-bundle conveyance direction. The second conveying member conveys the sheet bundle to a folding point after it is bound by the stapler and its downstream edges in the conveyance direction are aligned. The folding member folds the sheet bundle at the folding spot, and the retracting member retracts the first sheet-bundle regulating member from the path of the stapler.

However, in the conventional sheet processing devices described above, the stapler is kept positioned at the stapling position at all times and during aligning of sheets in an edge stapling process. Consequently, the edge of the sheets on the stapling side is unable to be pressed down by a pressing member. To enable the edges of the sheets on the stapling side to be pressed down, the stapler needs to be removed from the path of the pressing member during the alignment process, and brought back to the stapling position after the alignment process. However, this leads to a drop in productivity.

SUMMARY OF THE INVENTION

It is an object of the present invention to at least partially solve the problems in the conventional technology.

According to an aspect of the present invention, a sheet processing device includes a first collecting unit that collects sheets, an aligning unit that aligns the sheets on the collecting unit, a stapling unit that staples the sheets that have been aligned, and a clamping unit that clamps the sheets collected on the collecting unit. The stapling unit moves from a first standby position to a second standby position according to a preset condition.

According to another aspect of the present invention, an image forming apparatus includes a sheet processing device that includes a first collecting unit that collects sheets, an aligning unit that aligns the sheets on the collecting unit, a stapling unit that staples the sheets that have been aligned, and a clamping unit that clamps the sheets collected on the collecting unit. The stapling unit moves from a first standby position to a second standby position according to a preset condition.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
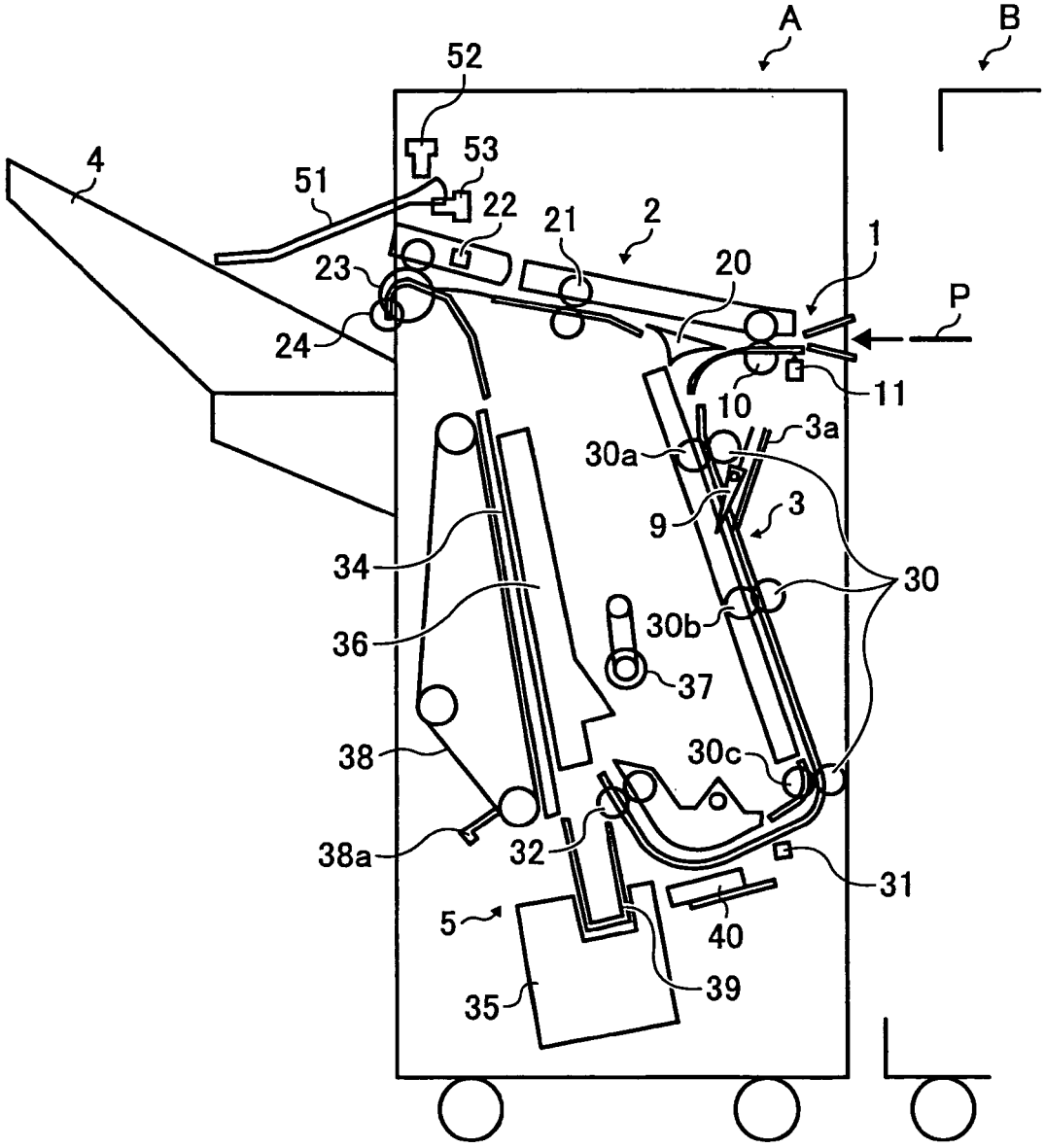
FIG. 1 is a schematic diagram of a system that includes a sheet processing device and an image forming apparatus according an embodiment of the present invention.

FIG. 1 is a schematic diagram of an image forming system formed of a sheet processing device A and an image forming apparatus according B to an embodiment of the present invention. The sheet processing device A includes a guiding path 1 that receives a sheet P ejected from the image forming apparatus B. The guiding path 1 branches off into an upper conveying path 2, which is oriented towards a sheet discharge tray 4, and a lower conveyance path 3 where a stapling process is performed. When it is detected during image formation that the sheet discharge tray 4 is filled to the brim, a control unit 72, described later, stops the image forming operation of the image forming apparatus B, thereby stopping all the operations related to image formation in the entire image forming system. On the guiding path 1 are located guiding rollers 10 and an inlet sensor 11. A path switching pawl 20 at the end of the guiding path 1 is swung to send the sheet P towards the upper conveyance path 2 or the lower conveyance path 3.

The sheets that are not conveyed into the lower conveyance path 3 are conveyed past conveying rollers 21, sheet discharge sensor 22, discharge rollers 23, and collecting rollers 24 disposed along the upper conveying path 2, and ejected and stacked in the sheet discharge tray 4. A free-swinging filler 51, located above the discharge outlet hangs over the sheet P stacked in the sheet discharge tray 4, its tip touching the surface of the sheet P near the center. At the base of the filler 51 are disposed an upper top-surface detecting sensor 52 and a lower top-surface detecting sensor 53, which detect height of the stacked sheets P by detecting the tip of the filler 51. The upper top-surface detecting sensor 52 is disposed above the base of the filler 51 and the lower top-surface detecting sensor 53 is disposed below the base of the filler 51. The base of the filler 51 is midway between the two top-surface detecting sensors 52 and 53 (when both the upper top-surface detecting sensor 52 and the lower top-surface detecting sensor 53 are off), and is near the lower top-surface detecting sensor 53 (when the lower top-surface detecting sensor 53 switches off) at the home position thereof.

The lower top-surface detecting sensor 53 is turned on as the number of sheets, in other words, the height of the sheet bundle, loaded in the sheet discharge tray 4 increases. When the lower top-surface detecting sensor 53 is turned on, the control unit 72 controls a driving unit (not shown) that raises or lowers the sheet discharge tray 4 to lower the sheet discharge tray 4. The control unit 72 controls the driving unit to stop the descent of the sheet discharge tray 4 when the lower top-surface detecting sensor 53 is turned off after the sheet discharge tray 4 is lowered. This process of lowering the sheet discharge tray 4 is repeated until the height stipulated for the sheet discharge tray 4 is reached, upon which, the control unit 72 of the sheet processing device A outputs a stop signal to a control unit 71 of the image forming apparatus B, causing the image forming operation by the system to be stopped.

A prestack path 3*a* branches off from the lower conveyance path 3 at an angle that enables the sheet P to be carried in a direction opposite to a direction in which the sheet P is conveyed (conveyance direction). A switching pawl 9 disposed at the bifurcation serves as a guide during this reverse passage of the sheet P. Conveying rollers 30 (30*a*, 30*b*, and 30*c*), a sheet discharge sensor 31, and sheet discharge rollers 32 are disposed along the lower conveyance path 3. A stapling device 5 is disposed at the end of the lower conveyance path 3. The stapling device 5 includes the stapler 35, the stapling tray 34, a jogger fence 36, returning rollers 37, a releasing belt 38, a releasing pawl 38*a*, a rear-end fence 39, and a rear-end clamp 40. The stapler 35 moves in a direction perpendicular to the conveyance direction (i.e., sheet width direction) and staples the sheet bundle with a stapling pin by advancing in a direction perpendicular to the sheet surface. The stapling tray 34 stacks therein the sheet P ejected from the sheet discharge rollers 32. The jogger fence 36 aligns the sheet P in the stapling tray 34 by advancing or retreating in a direction perpendicular to the conveyance direction. The returning rollers 37 return the sheet P in the stapling tray 34 towards upstream of the conveyance direction. The releasing belt 38 releases the sheet P or the sheet bundle from the stapling tray 34 towards the sheet discharge tray 4. The releasing pawl 38*a* is affixed to the releasing belt 38 and pushes up the sheet P or the sheet bundle being released by the releasing belt 38. The rear-end fence 39 aligns the trailing edge of the sheet P returned by the returning rollers 37. The rear-end clamp 40 presses down on or releases the sheet bundle by advancing or retreating in the thickness direction of the sheet bundle.

How a sheet bundle of one lot is processed by the sheet processing device is described below. The sheet P, output from the image forming apparatus B and carried to the sheet processing device A, is detected by the inlet sensor 11 and is conveyed through the upper conveyance path 2. The control unit 72 determines the position of the path switching pawl 20 according to a sheet processing command issued by the control unit 71 of the image forming apparatus B. To carry the sheet P to the stapling tray 34, the path switching pawl 20 is turned counterclockwise in FIG. 1 to guide the sheet P to the lower conveyance path 3. The space for carrying the sheet P in the lower conveyance path 3 is secured by a carrying force of the sheet P exerted by the guiding rollers 10 and the conveying rollers 30*a* disposed at the upstream end in the conveyance direction, by which the switching pawl 9 is pushed counterclockwise in FIG. 1. Thus, the sheet P is guided further downstream into the lower conveyance path 3 through the conveying rollers 30*b*, disposed midway in the conveyance direction, and the conveying rollers 30*c*, disposed at the downstream end in the conveyance direction, and is ejected into the stapling tray 34 by the sheet discharge rollers 32.

Once released from a nip between the sheet discharge rollers 32 and deposited in the stapling tray 34, the sheet P drops onto the rear-end fence 39 by self-weight and by the returning rollers 37, where the trailing edge of the sheet P rests flush against the rear-end fence 39. After the lapse of time for alignment of the sheet P in the conveyance direction, the sheet P is aligned in the width direction by the jogger fence 36. This alignment process is repeated for every sheet P, whereby a plurality of sheets are aligned one by one.

How the sheet bundles of two or more lots are processed is described below. The sheets P are output from the image forming apparatus B at regular intervals and the interval between the lots is also constant. The first sheet P output from the image forming apparatus B is carried past the guiding rollers 10 and the conveying rollers 30*a* disposed in the upstream end in the conveyance direction, and past the switching pawl 9 up to a predetermined distance downstream such that the trailing edge of the sheet P gets past the tip end of the switching pawl 9 (but not past the conveying rollers 30*b* disposed in the mid-portion in the conveyance direction). If a signal is issued from the control unit 71 of the image forming apparatus B to carry the sheet P in the reverse direction, the conveying rollers 30*b* and 30*c* first stop turning and then start turning in the reverse direction. The switching pawl 9 then guides the sheet P to the prestack path 3*a* where it is pre-stacked. The switching pawl 9 is always elastically biased by force to give way to the prestack path 3*a* when the sheet P is carried in the reverse direction (i.e., a degree of force that allows the switching pawl 9 to rotate enough to let the sheet P pass through). The distance which the sheet P is carried in the prestack path 3*a* is calculated by taking a pulse count of a sensor (not shown) disposed immediately before the conveying rollers 30*a* in the conveying direction or by measuring time by a timer (not shown). Control timing is obtained based on the calculated pulse count or the measured time, and the sheet P is stopped when the trailing edge of the sheet P (the leading edge of the sheet P, when the sheet P is being carried in the reverse direction) is at the correct position. At this point, the sheet P is held by a nip between the conveying rollers 30*b* such that the sheet P sticks out a few millimeters from the nip. To reduce the distance that the sheet P sticks out from the nip, another sensor is placed as close as possible to the spot where the reverse movement of the sheet P begins. Thus, a conveyance error is reduced, and the sheet P is stopped at the precise spot. By stopping the sheet at the precise spot, the distance that the sheet P sticks out from the nip can be minimized. Consequently, the next sheet can be stacked on the current sheet P with a minimal gap, resulting in a reasonably well aligned stack in the stapling tray 34.

The second sheet is then conveyed by the conveying rollers 30*a*. When the sensor disposed immediately before the conveying rollers 30*a* in the upstream direction detects that the second sheet has been conveyed in the upstream direction up to a predetermined distance, e.g. 20 mm, from the conveying rollers 30*b*, the conveying rollers 30*b* and 30*c* begin to rotate in the reverse direction. Accordingly, conveyance of the first sheet P stacked on the lower conveyance path 3 and the prestack path 3*a* is restarted. Upon restart of conveyance, the first sheet P is held between a nip between the conveying rollers 30*c* on the downstream end, and the first sheet P and the second sheet are ejected into the stapling tray 34 together with the leading edge of the first sheet P slightly ahead of the leading edge of the second sheet.

If there are three sheets in a lot, the first sheet P and the second sheet are pre-stacked in the prestack path 3*a* and kept waiting until the third sheet comes along. The number of sheets kept waiting in the prestack path 3*a* is determined by a processing time of the previous lot of sheet bundle in the stapling tray 34.

A stapling process is described below. When an stapling mode signal is received from the image forming apparatus B, the stapler 35 moves in the width direction of sheets up to a predetermined point along the bottom edge of a sheet bundle and stands by at that point. A sheet carried via the lower conveyance path 3 is ejected into the stapling tray 34 by the sheet discharge rollers 32. The sheet comes up against the returning rollers 37 which drops the sheet downward so that the sheet comes to rest against the rear-end fence 39. The rear-end fence 39 aligns the sheet bundle in the conveyance direction (vertically). The jogger fence 36 aligns the sheet bundle in the width direction. When a sheet is dropped into the rear-end fence 39, the rear-end clamp 40 presses down on the sheet towards the stapling tray 34 so that the next sheet can be dropped into the rear-end fence 39.

When a predetermined number of sheets are aligned, the stapler 35 moves from the standby position to a stapling position, and staples the sheet bundle. With the lower edge (trailing edge) being supported by the releasing pawl 38*a*, the stapled sheet bundle is carried by the releasing belt 38 counterclockwise in FIG. 1, and ejected into the sheet discharge tray 4. In the stapling mode, the base of the filler 51 is near the upper top-surface detecting sensor 52, having turned from off to on, at the home position thereof. When the upper top-surface detecting sensor 52 turns off in response to increase in the height of the bundle of sheets in the sheet discharge tray 4, the control unit 72 controls the driving unit (not shown) to lower the sheet discharge tray 4. As the sheet discharge tray 4 is lowered, the upper top-surface detecting sensor 52 is turned on, and the sheet discharge tray 4 is stopped from being lowered. This action is repeated until the height stipulated for the sheet discharge tray 4 is reached, upon which the control unit 72 of the sheet processing device A outputs a stop signal to the control unit 71 of the image forming apparatus B, thereby stopping the image forming operation of the system.

FIGS. 2 to 7 are schematic diagrams for explaining sheet-alignment operation and stapling-position control performed by the sheet processing device A.

Figure 2:
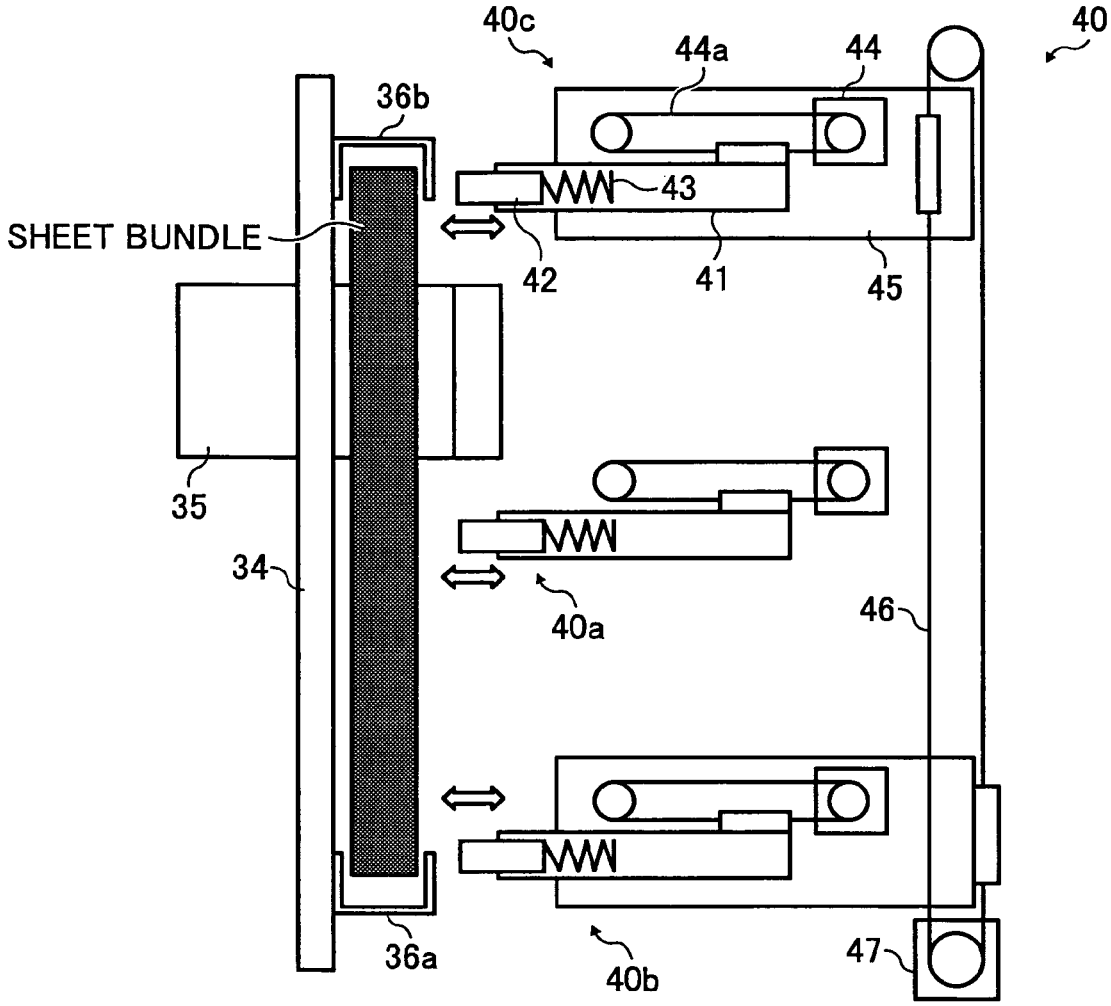
FIGS. 2 to 7 are schematic diagrams for explaining sheet-alignment operation performed by the sheet processing device.

When the control unit 72 of the sheet processing device A receives an interior-edge stapling mode signal from the control unit 71 of the image forming apparatus B, the stapler 35 and the jogger fence 36 (36*a* and 36*b*) move to the positions shown in FIG. 2. The stapler 35 comes to a standby position where it does not come in the way of a rear-end clamp 40*c*. A motor 47 moves a trailing-edge rear-end clamp 40*b* and the leading-edge rear-end clamp 40*c* to allow for adjustment according to variation in sheet size. Specifically, the rear-end clamps 40*b* and 40*c* are affixed to a guide shaft (not shown) and a belt 46 via a slider 47. The rear-end clamps 40*b* and 40*c* extend around a pulley, and are driven by the motor 47. This configuration allows the rear-end clamps 40*b* and 40*c* to move symmetrically in the width direction of the sheet. The amount of their movement is greater than the width of the sheet. When the staple mode signal and sheet size information is received from the image forming apparatus B, the rear-end clamps 40*b* and 40*c* move to the respective edges of a sheet according to the sheet size and stand by there.

As each sheet P is carried to the stapling tray 34, the returning rollers 37 align the position of the sheet P vertically while the jogger fence 36 aligns the position of the sheet P horizontally. Next, the buckling or the curl of the sheet in the stapling tray 34 is regulated so that the next sheet P can be ushered into the rear-end fence 39. This is accomplished by a motor 44 that moves a belt 44*a*, thereby causing a supporting member 41 of a clamping member 42 to approach the sheet P and leading the trailing edge of the sheet P towards the stapling tray 34. When the next sheet P is being conveyed into the stapling tray 34, the clamping member 42 retreats from the sheet P to return to the standby position (shown in FIG. 2), awaiting the deposition of the sheet P in the stapling tray 34. This movement of the clamping member 42 is identical in all the three rear-end clamps 40*a* to 40*c*.

Figure 3:
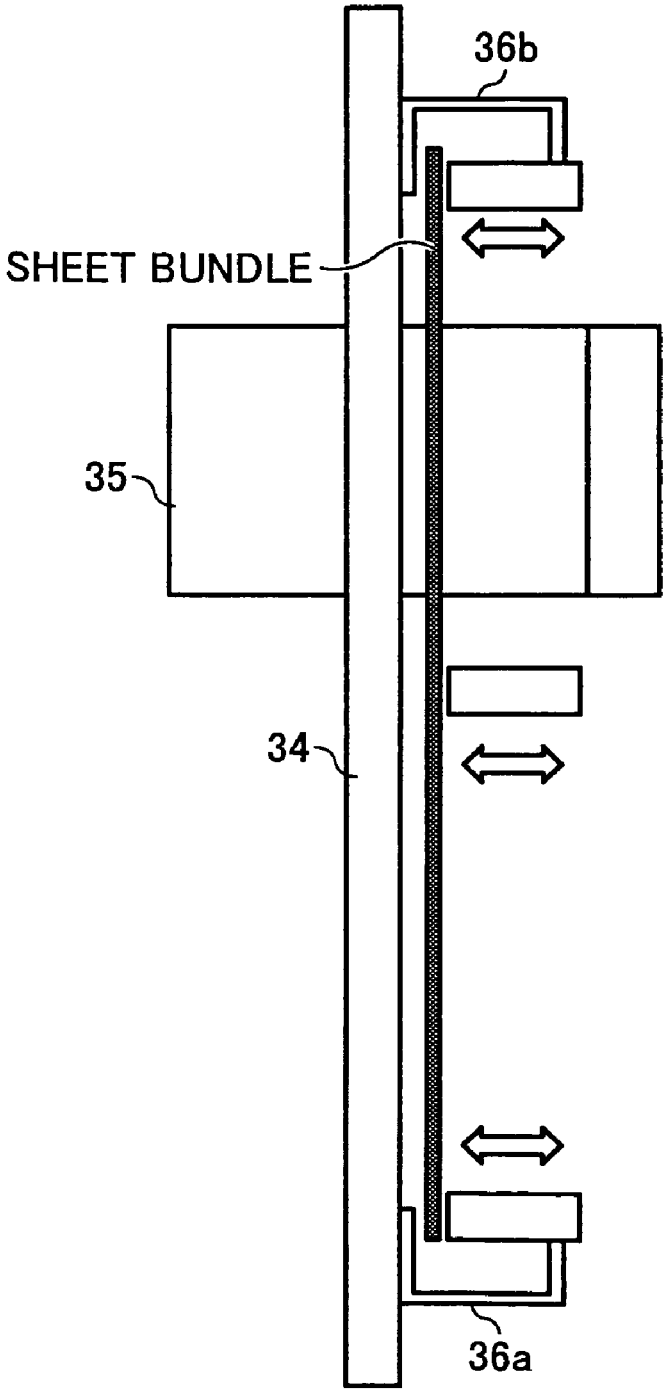
Figure 4:
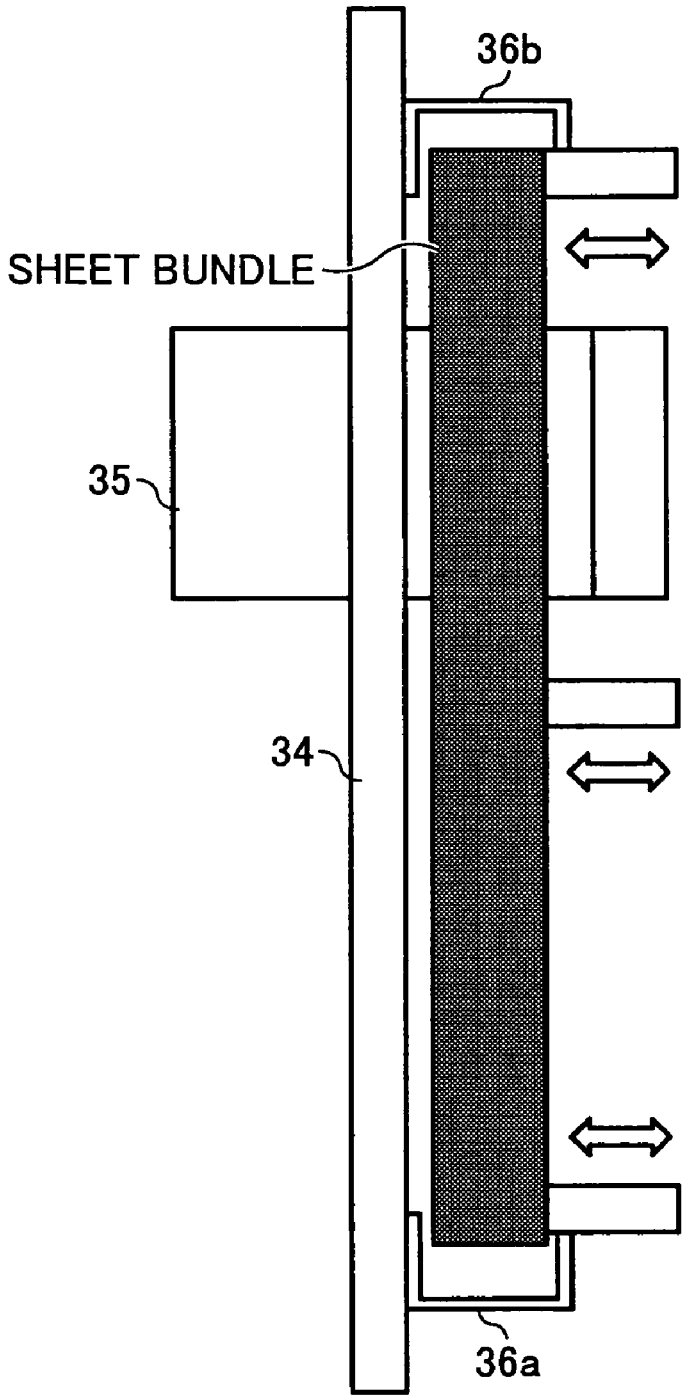

The control unit 72 determines counts the number of sheets in the stapling tray 34 and, as shown in FIGS. 3 and 4, drives the motor 44 to change a clamping amount of the rear-end clamps 40 according to the sheet count. Thus, even if the thickness (sheet count) of a sheet bundle varies, a constant clamping amount can be maintained. If a sheet bundle is thicker than usual due to the use of thick sheets, an elastic member 43 provided in the rear-end clamp 40 biases the clamping member 42, so that the clamping member can retreat when pressing the sheet bundle more than necessary, thus avoiding excessive clamping.

Figure 5:
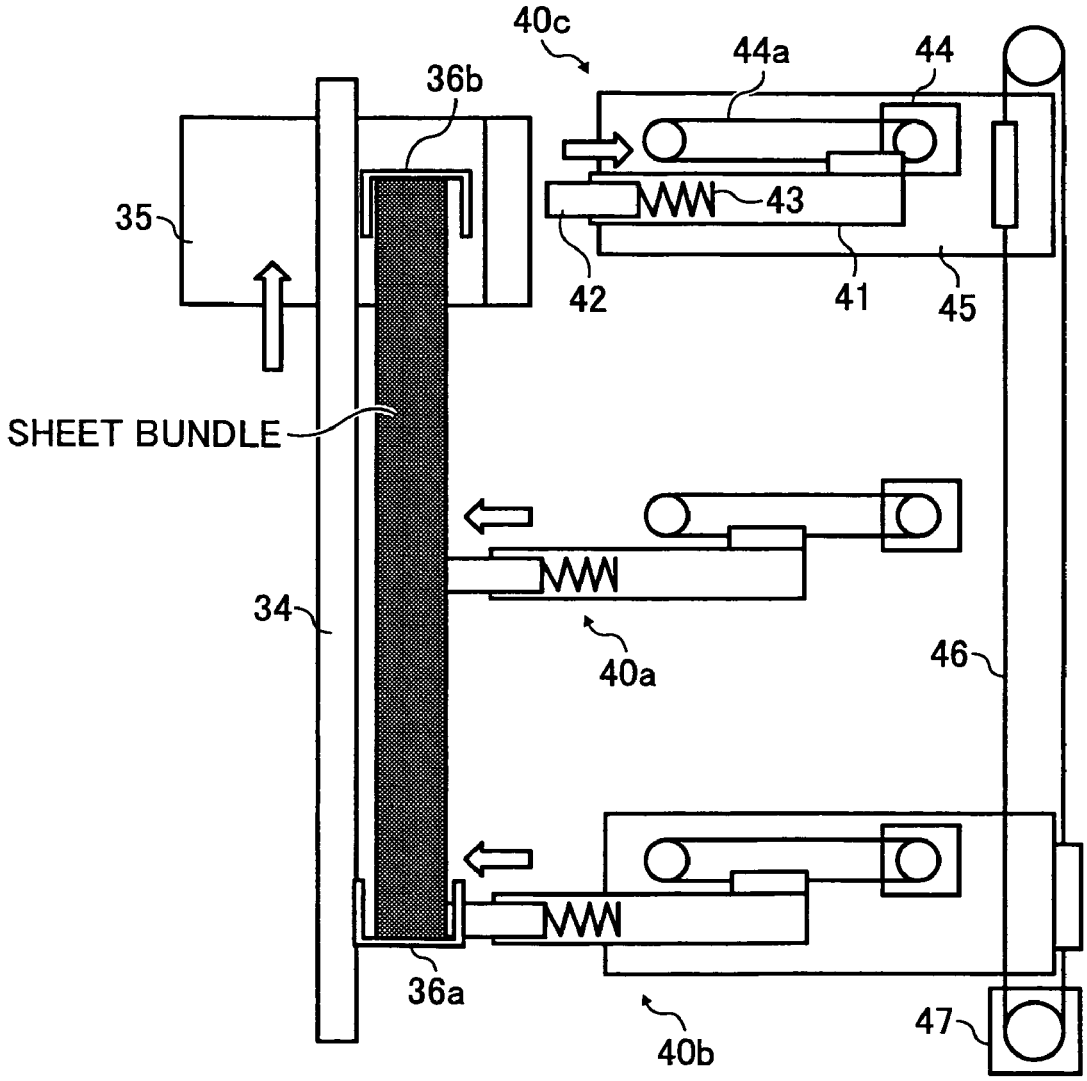
Figure 6:
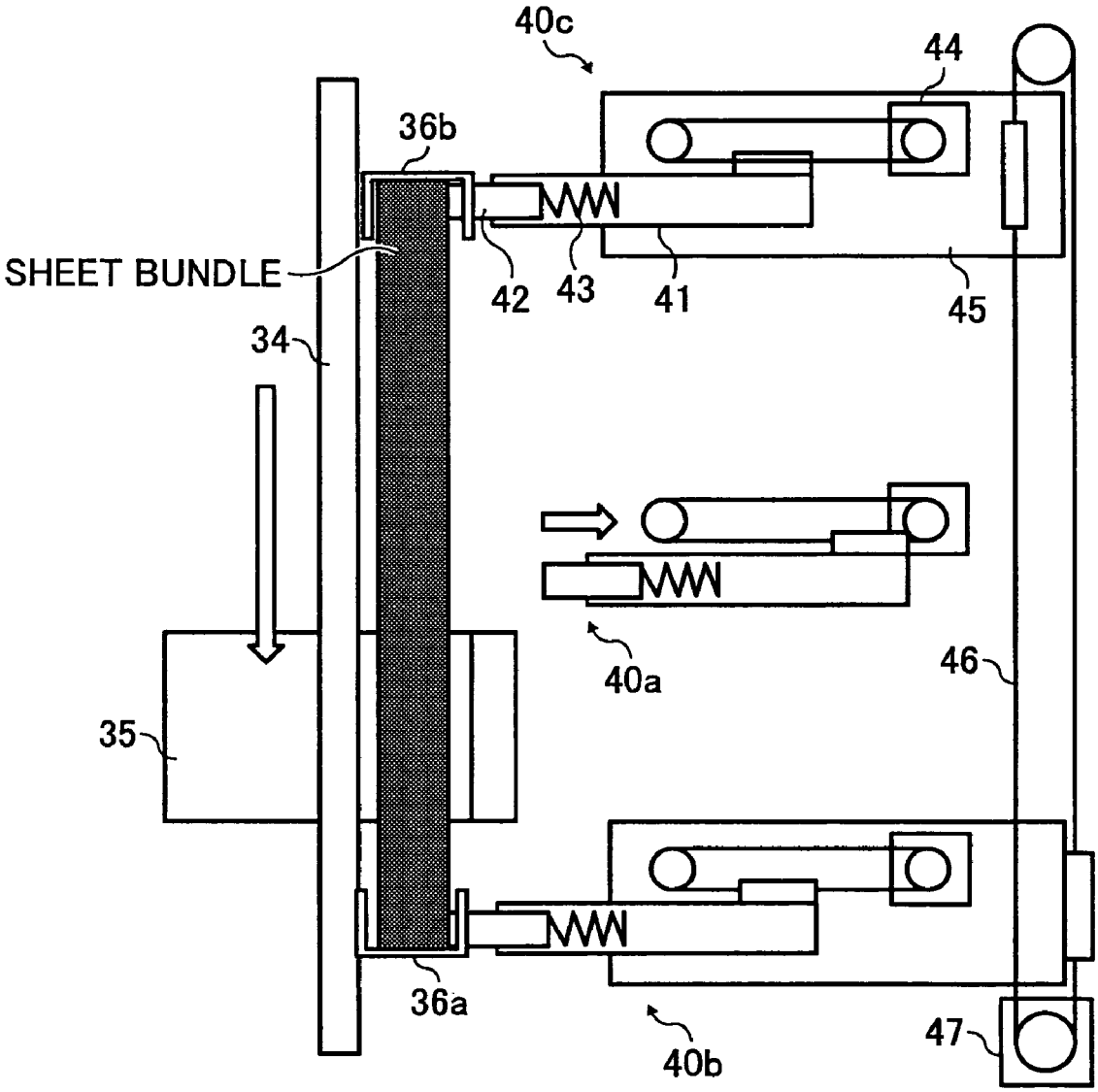
Figure 7:
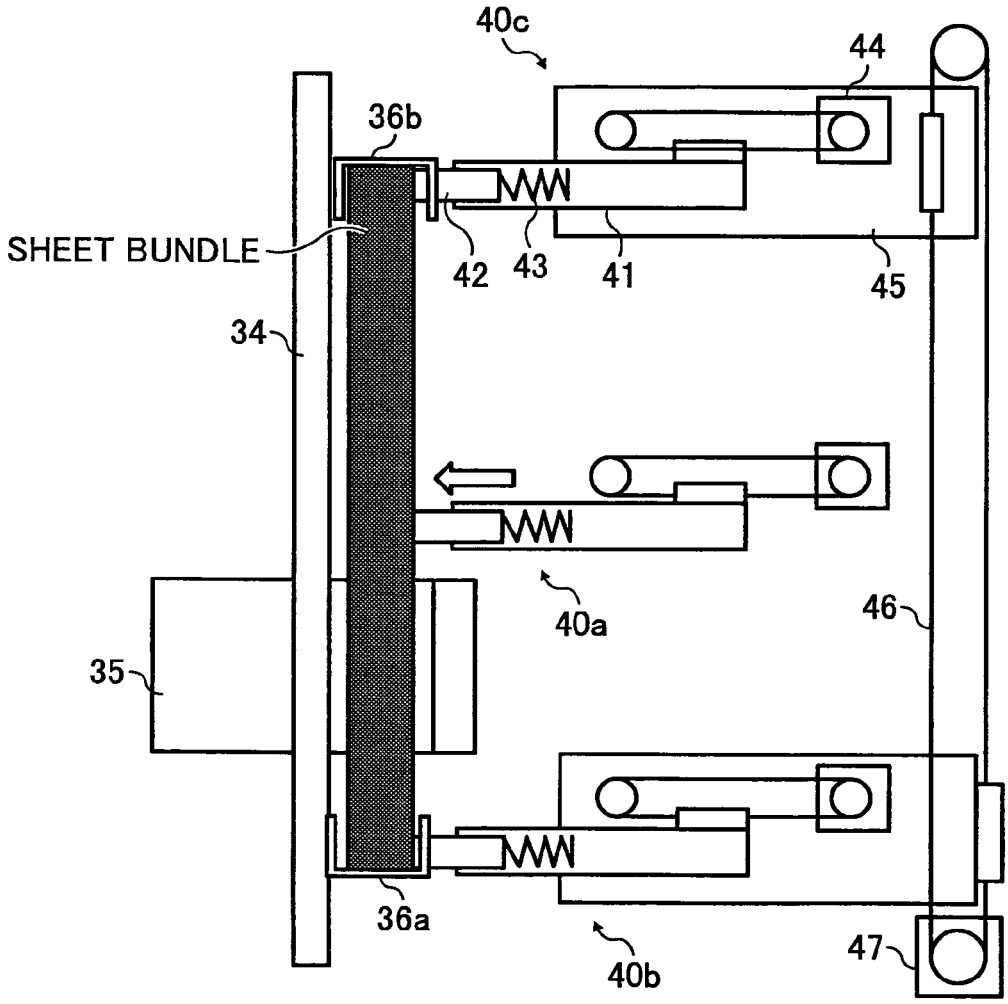

After the sheets are aligned, as shown in FIG. 5, the rear-end clamp 40*c* at the stapling end retreats not to get in the way of the stapler 35. The stapler 35 moves to the stapling position and staples the sheet bundle while the rear-end clamps 40*a* and 40*b* are clamping the sheet bundle. If stapling is performed at the opposite end, i.e., at the end where the rear-end clamp 40*b* is located, the stapler 35 moves to the stand-by position in the opposite direction, and the rear-end clamp 40*b* retreats instead of the rear-end clamp 40*c*. When stapling is performed at two spots, after stapling is performed at one spot, the stapler 35 is moved to the second spot. The rear-end clamp 40*a* retreats to let the stapler 35 pass, as shown in FIG. 6, and returns to the clamping position once the stapler 35 gets past, as shown in FIG. 7. The standby position (retreating position) of the stapler 35 is a position that is out of the way of the rear-end clamps 40*a* to 40*c* and is closest to the next stapling position.

Figure 8:
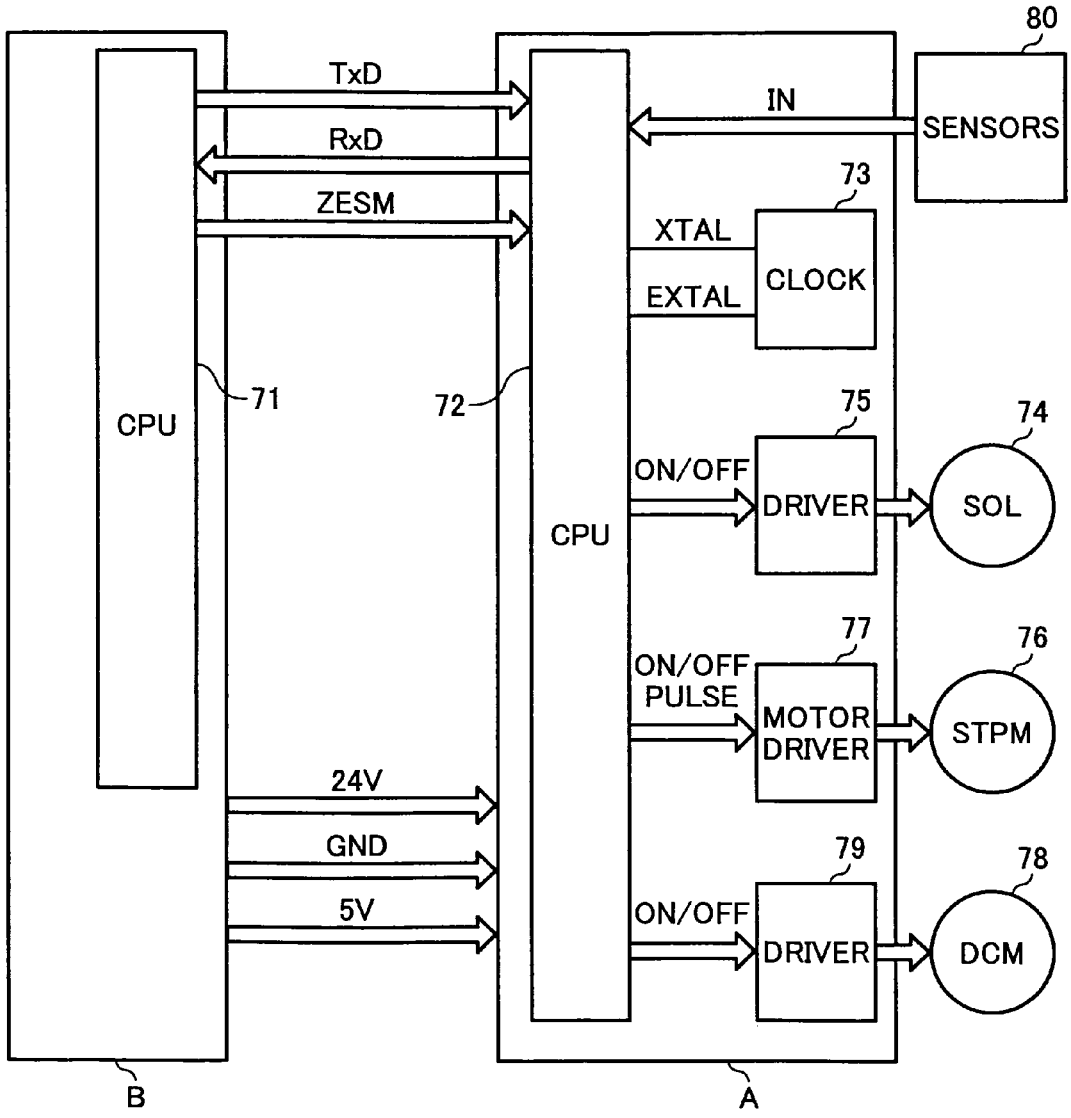
FIG. 8 is a block diagram of the image forming apparatus according to the embodiment in terms of its electrical (control) configuration.

FIG. 8 is a block diagram of the image forming apparatus B in terms of its electrical (control) configuration. The control units 71 and 72 of the image forming apparatus B and the sheet processing device A each include a central processing unit (CPU). The CPUs of the control units 71 and 72 perform required communication (TxD, RxD, ZESM) with each other. A driving power (24 V) and a control power (5 V) are fed from the image forming apparatus B to the sheet processing device A. Both the image forming apparatus B and the sheet processing device A have the same ground (GND) potential. The sheet processing device A includes a clock generating unit 73, a solenoid driver 75 for driving a solenoid 74, a motor driver 77 for driving a stepping motor 76, and a DC motor driver 79 for driving a direct-current (DC) motor 78. The control unit (CPU) 72 outputs driving signals to the solenoid driver 75, the motor driver 77, and the DC motor driver according to detection outputs from various sensors 80.

In this mechanism where the stapler 35 and the rear-end clamps 40*a* to 40*c* are disposed in a range in which they come in the way of one another, the stapler 35 is kept retreated not to come in the way of the rear-end clamps 40*a* to 40*c* when sheets are being aligned and then moved to the stapling position after the aligning process is completed and just before the stapling process. However, when compared with the case where the stapler 35 is already at the stapling position, in this arrangement, the total time required for stapling process increases by the time that the stapler 35 takes to move from the standby position to the stapling position. This surplus time will not lead to reduced productivity if it can be absorbed before the first sheet of the next sheet bundle (next lot) is received. Otherwise, the productivity is bound to decline.

Figure 9:
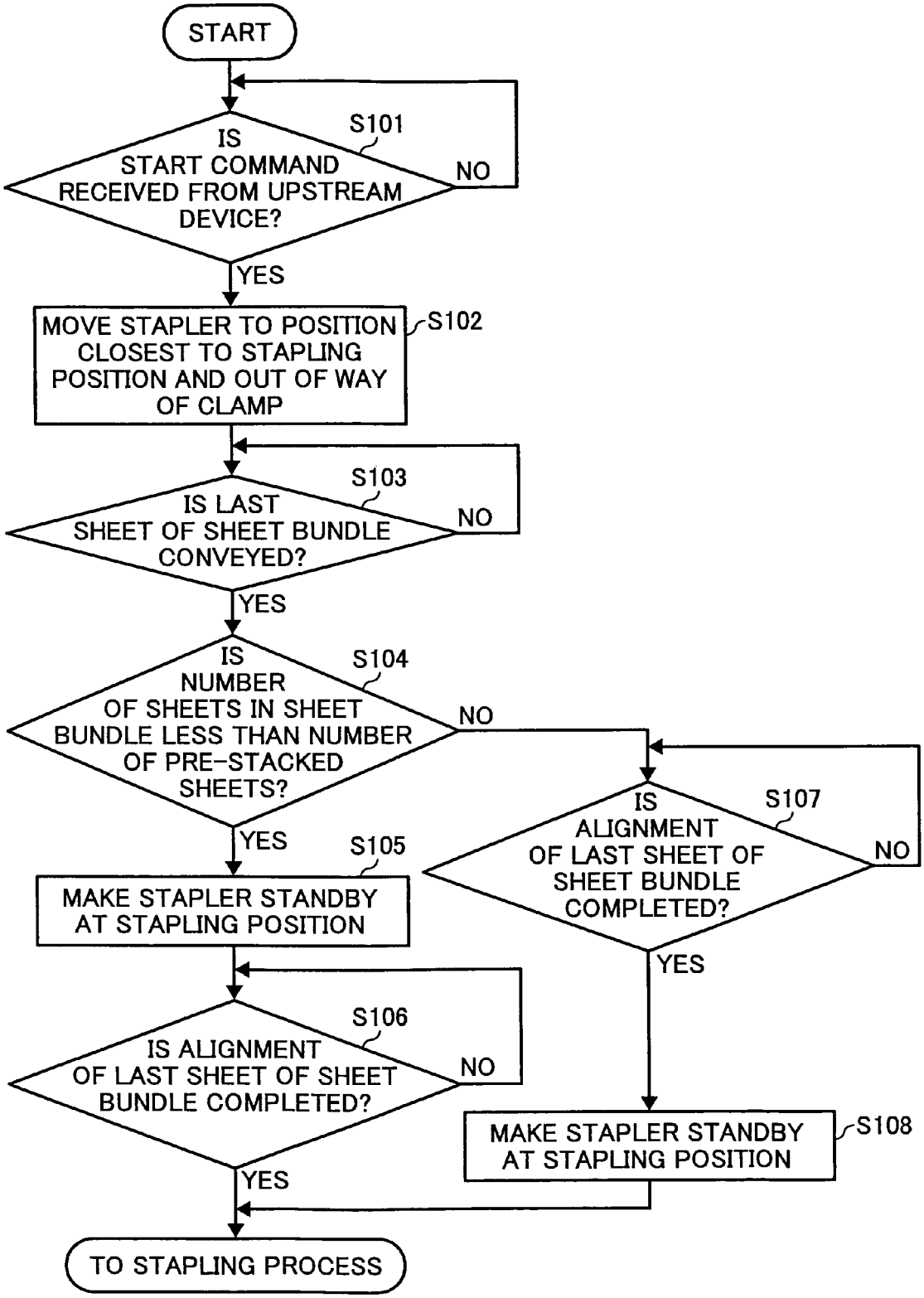
FIG. 9 is a flowchart of a control process for shifting a standby position of a stapler shown in FIG. 1.

Accordingly, under a predetermined condition, the stapler 35 is moved to the stapling position before completion of alignment process of the last sheet of a sheet bundle. This control is explained below with reference to FIG. 9. FIG. 9 is a flowchart of a control process for shifting the standby position of the stapler 35.

When the sheet processing device A receives a start signal from the image forming apparatus B (step S101), the stapler 35 is moved to a position which is out of the way of the rear-end clamps 40*a* to 40*c* while being closest to the stapling position (step S102). For example, in the case of single-spot stapling, the stapler 35 is moved to the near-side stapling position for two-spot stapling (the position of the stapler 35 in FIG. 2), and is kept standing by in that position until the last sheet of a sheet bundle is conveyed into the stapling tray 34. Once the last sheet is conveyed into the stapling tray 34 (step S103), the sheet processing device A compares the currently set number of pre-stacked sheets (the number of sheets that are kept in the prestack path 3*a* and ejected along with the next sheet into the stapling tray 34) and the number of sheets for stapling (step S104). If the number of sheets for stapling is less than the number of pre-stacked sheets (Yes at step S104), the stapler 35 is moved to the stapling position (the position of the stapler 35 in FIG. 5) before the alignment process of the last sheet is completed (step S105). When the alignment process of the last sheet of the sheet bundle is completed (step S106), the stapling process is performed. In this way, stapling process can be completed without requiring extra time, which enhances productivity. The stapling process described above is performed while two out of the three rear-end clamps 40*a* to 40*c* are pressing down on the sheet bundle.

If the number of sheets for stapling is equal to or greater than the number of pre-stacked sheets (No at step S104), enough time is available for moving the stapler 35. Therefore, after the alignment process of the last sheet is completed (step S107), the stapler 35 is moved to the stapling position (step S108). In this case, as enough time is available for moving the stapler 35, the stapling process is performed while the sheet bundle is pressed down by all the three rear-end clamps 40*a* to 40*c* as shown in FIG. 7, which enhances stapling precision.

Thus, in the control process shown in FIG. 9, productivity is enhanced by the process of steps S104 to S106, and stapling precision is enhanced by the process of steps S104, S107, and S108. Accordingly, the best course of action is determined in the available time until the next sheet is received. That is, in the process of steps S104 to S106, the standby position of the stapler 35 is at where the rear-end clamp 40*b* or 40*c* is located as shown in FIG. 5, while in the process of steps S104, S107, and S108, the standby position of the stapler 35 is between two adjoining rear-end clamps (between the rear-end clamps 40*a* and 40*b* or 40*c*) as shown in FIG. 2 or 7.

Figure 10:
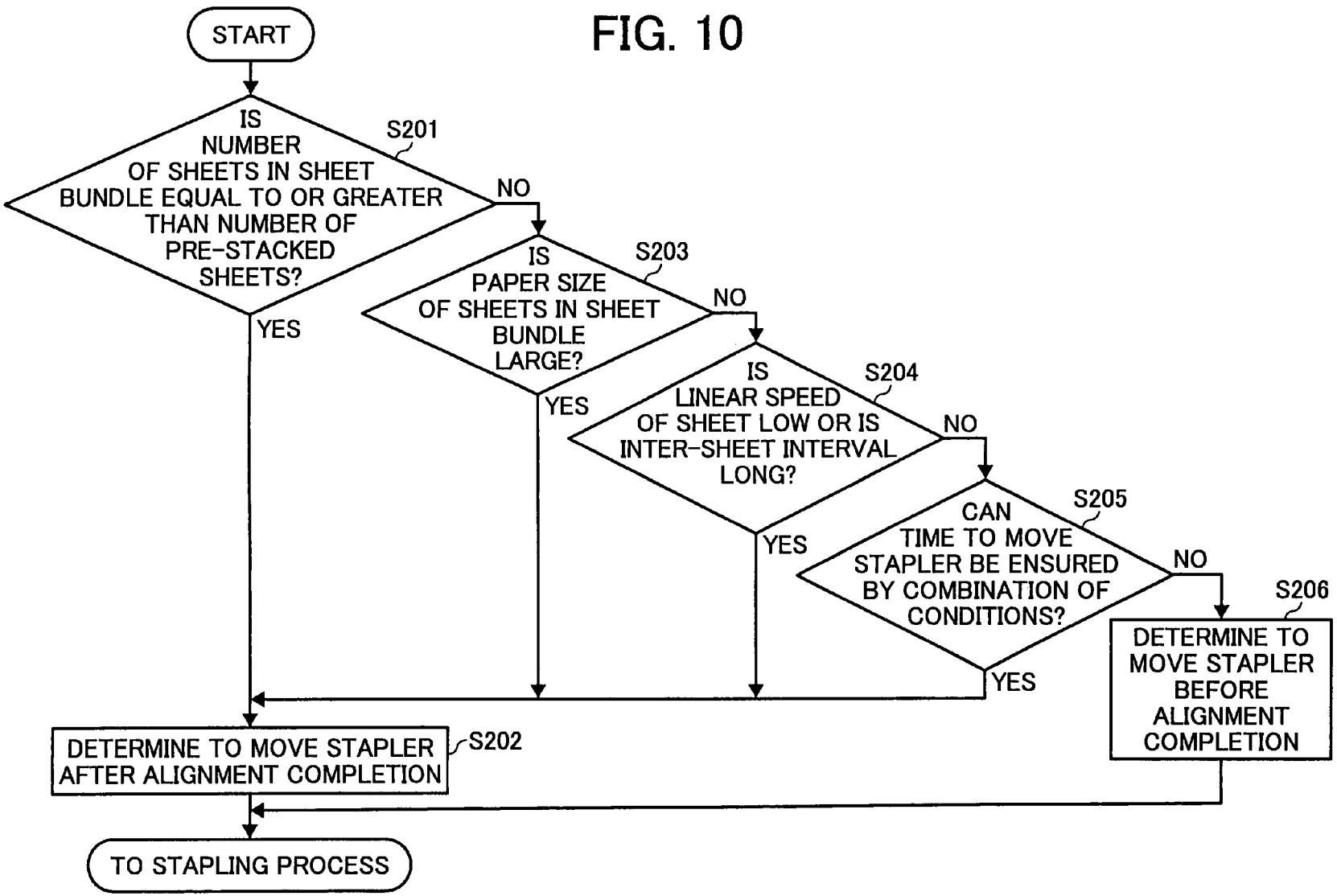
FIG. 10 is a flowchart of the process of determining timing for moving the stapler.

Several factors such as a linear ejection speed, interval between sheets, sheet size, and the number of sheets for stapling affect the available time. For example, if the number of sheets for stapling is greater than the number of sheets that are pre-stacked, a larger number of sheets ejected from the image forming apparatus B are to be stacked, and hence plenty of time is available for processing. Even if the number of sheets for stapling is small, if the sheet size is large, such as A3, or the linear ejection speed of the sheet from the image forming apparatus B is low or the intervals between the sheets (inter-sheet intervals) are long due to the sheet-carrying specification of the image forming apparatus B, plenty of time is available for processing. Even if not enough time is available under individual conditions, combinations of these conditions may ensure plenty of time for processing. Thus, if more time than the total time required for the stapling process from alignment to ejection can be available before the first sheet of the next job or the pre-stacked sheet bundle of the next job is conveyed into the stapling tray 34, the sheet processing device acts to enhance stapling precision. Otherwise, the sheet processing device acts to enhance productivity. FIG. 10 is a flowchart of the process of determining move timing of the stapler 35.

If the number of sheets for stapling is equal to or greater than the number of pre-stacked sheets (Yes at step S201), the sheet processing device A determines to move the stapler 35 after completion of alignment process (step S202). If the number of sheets for stapling is less than the number of pre-stacked sheets (No at step S201), and the sheet size of the sheets for stapling is large, such as A3, the sheet processing device A determines to move the stapler 35 after completion of alignment process (step S202). If the sheet size is not large (No at step S203), the sheet processing device A determines whether the linear ejection speed is low or whether the inter-sheet intervals are long (step S204) based on the sheet-carrying specification of the image forming apparatus B. If the linear ejection speed is low or the inter-sheet intervals are long (Yes at step S204), the sheet processing device A determines to move the stapler 35 after completion of alignment process (step S202). If the linear ejection speed is high or the inter-sheet intervals are short (No at step S204), the sheet processing device A determines, based on predetermined conditions, whether more time can be taken for the first sheet of the next job or the pre-stacked sheet bundle of the next job to be conveyed into the stapling tray 34 than the total time required for the stapling process inclusive of all the processes from alignment to ejection (step S205). If more time is available (Yes at step S205), the sheet processing device A determines to move the stapler 35 after completion of alignment process (step S202). Otherwise (No at step S205), the sheet processing device A determines to move the stapler 35 before completion of alignment process (step S206), and proceeds to the stapling process.

Situations can be envisaged where stapling precision may take precedence over productivity. To address this requirement, it is selected whether to perform the control process for shifting the standby position of the stapler 35, rendering the sheet processing device A more flexible. For example, the sheet processing device A can be provided with a manual operation button to specify whether to perform the control process for shifting the standby position of the stapler 35. Alternatively, selection of whether to perform the control process for shifting the standby position of the stapler 35 can be made from an operation unit of the image forming apparatus B (for example, by setting in serviceman program (SP) mode). Such selection can also be made through a command issued over a network to the image forming apparatus B and subsequently passed on to the sheet processing device A. In any case, a user can directly or indirectly specify or change the settings, and thus, it can be determined whether to perform the control process for shifting the standby position of the stapler 35 for every job.

Figure 11:
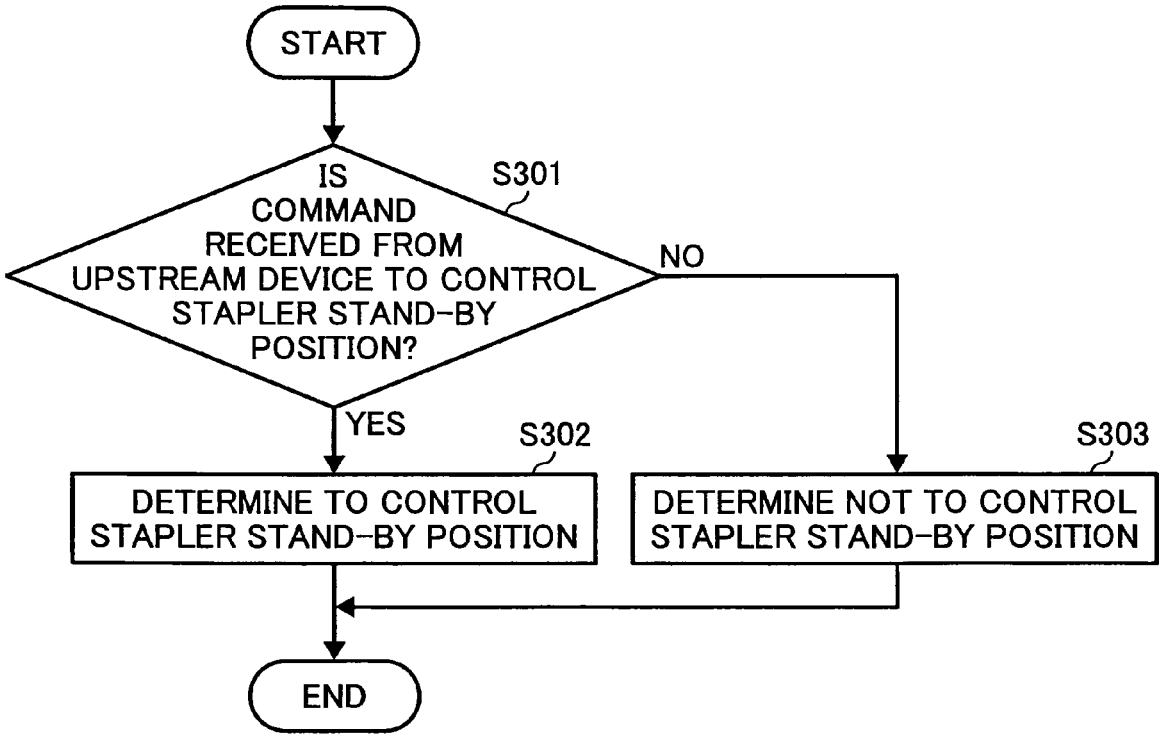
FIG. 11 is a flowchart of the process of determining whether to control a stapler standby position.

FIG. 11 is a flowchart of the process of determining whether to perform the control process for shifting the standby position of the stapler 35. The sheet processing device A first checks whether there is a command from the image forming apparatus B directing to perform the control process for shifting the standby position of the stapler 35 (step S301). If there is such a command (Yes at step S301), the sheet processing device A determines to perform the control process (step S302). Otherwise (No at step S301), the sheet processing device A does not perform the control process (step S303).

There are four standby positions at which the stapler 35 stands by, i.e., at the rear-end clamp 40*b* and 40*c* on both edges, as shown in FIG. 2, and between the rear-end clamp 40*b* and the rear-end clamp 40*a*, and between the rear-end clamp 40*c* and the rear-end clamp 40*a*, as shown in FIGS. 5 and 7. The former two positions are for enhancing productivity, and the latter two positions are for enhancing stapling precision. The process directed towards enhanced stapling precision is performed when the stapler 35 has enough time to move to the stapling position by the time a sheet of the next lot is ejected into the stapling tray 34 after the alignment process is completed for a sheet or a sheet bundle of the previous lot ejected into the stapling tray 34. Under such a condition, the standby position of the stapler 35 is between the rear-end clamp 40*a* and either the rear-end clamp 40*b* or 40*c*. Under other conditions, the standby position of the stapler 35 is at the stapling position. When the stapler 35 is standing by at the stapling position, the rear-end clamp 40*b* or 40*c* is not in operation, and stays retreated and out of the way of the stapler 35.

As set froth herein above, according to an embodiment of the present invention, productivity is enhanced by minimizing the distance a stapler has to move, and is maintained by moving the stapler to a stapling position before commencement of the stapling process. This process for enhancing productivity is performed according to sheet ejection condition. Thus, either enhanced stapling precision or enhanced productivity can be realized as desired.

Moreover, plenty of time can be made available for moving the stapler by increasing the number of sheets ejected in one lot into a stapling tray.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing device, comprising:

a first collecting unit that collects sheets;

an aligning unit that aligns the sheets on the collecting unit;

a stapling unit that staples the sheets that have been aligned; and a clamping unit that clamps the sheets collected on the collecting unit, the clamping unit includes a first rear-end clamp, a second rear-end clamp, and a third rear-end clamp, wherein the stapling unit moves to a plurality of standby positions according to a preset condition, and during the plurality of standby positions, the stapling unit does not interfere with the clamping unit, while being closest to a position to be stapled, by retreating to let the stapling unit pass thereto.

2. The sheet processing device according to claim 1, wherein one of the plurality of standby position is before the aligning unit completes aligning the sheets.

3. The sheet processing device according to claim 1, wherein the preset condition is at least one of number of sheets to be stapled, sheet size, linear ejection speed, inter-sheet interval, and data received from outside.

4. The sheet processing device according to claim 1, wherein the stapling unit moves in a direction perpendicular to a direction in which the sheets are conveyed.

5. The sheet processing device according to claim 4, wherein one of the plurality of standby position is set to correspond to a position to be stapled.

6. The sheet processing device according to claim 4, wherein the clamping unit includes a plurality of clamping units, and one of the plurality of standby position is set to a position between the clamping units.

7. The sheet processing device according to claim 1, wherein the second rear-end clamp is positioned between the first rear-end clamp and the third rear-end clamp.

8. The sheet processing device according to claim 7, wherein in the stapling position, the second and third rear-end clamps press down on the collected sheet.

9. The sheet processing device according to claim 8, wherein if stapling is performed at opposite end, the first and second rear-end clamps retreat respectively, to let the stapling unit pass thereto and return respectively, to a clamping position.

10. The sheet processing device according to claim 1, wherein during a stapling position, two out of three rear-end clamps are pressed down on the collected sheet.

* * * * *